US005260530A

United States Patent [19]

Duhon et al.

[11] Patent Number: 5,260,530

[45] Date of Patent: Nov. 9, 1993

[54] ILLUMINATED, PRESSURE-ACTUATED SWITCH

[75] Inventors: Edward W. Duhon, Setauket; Timothy DiPeri, Bayport, both of N.Y.

[73] Assignee: Tapeswitch Corporation of America, Farmingdale, N.Y.

[21] Appl. No.: 891,297

[22] Filed: May 29, 1992

Related U.S. Application Data

[63] Continuation-in-part of Ser. No. 491,542, Mar. 12, 1990, Pat. No. 5,118,910.

[51] Int. Cl.[5] ..... H01H 3/02

[52] U.S. Cl. ..... 200/86 R; 200/303; 200/317; 362/251; 362/802

[58] Field of Search ..... 362/222, 223, 130, 251, 362/802, 23, 31; 340/573, 665, 666, 667; 174/52.3; 200/86 R, 86 A, 85 R, 294, 302.1, 310, 313, 317, 333, 303

[56] References Cited

U.S. PATENT DOCUMENTS

| | | | |
|---|---|---|---|
| 3,221,217 | 11/1965 | Hucke | 174/52.3 |
| 3,983,341 | 9/1976 | Stanish | 200/303 |
| 4,075,442 | 2/1978 | Fukuda | 200/303 |
| 4,247,747 | 1/1981 | Swatten . | |
| 4,258,096 | 3/1981 | LaMarche . | |
| 4,293,752 | 10/1981 | Koenig . | |
| 4,425,601 | 1/1984 | Donahue . | |
| 4,497,989 | 2/1985 | Miller | 200/86 R |
| 4,551,595 | 11/1985 | Koenig et al. . | |
| 4,551,713 | 11/1985 | Aossey . | |
| 4,670,725 | 6/1987 | Ahs . | |
| 4,947,298 | 8/1990 | Stephen . | |
| 4,987,277 | 1/1991 | Duhon | 200/86 R |
| 5,095,409 | 3/1992 | Dematteo | 362/23 |
| 5,118,910 | 6/1992 | Duhon | 200/86 R |
| 5,142,109 | 8/1992 | O'Meara, Jr. | 200/86 R |

OTHER PUBLICATIONS

"See Surface Illumination In A New Light . . . " Brochure of Luminescent Systems, Inc. of Lebanon, New Hampshire.

*The Design Guide to Electroluminescent Lighting*, Luminescent Systems, Inc., Lebanon, New Hampshire.

*Primary Examiner*—Gerald P. Tolin

*Attorney, Agent, or Firm*—Hoffman & Baron

[57] ABSTRACT

An illuminated, press-at-any-point switching device which can be actuated by the application of or the removal of pressure at substantially any point along a surface of the switching device. The illuminated, press-at-any point switching device includes a cover, an illuminating member, a switching assembly and a mounting surface. The cover holds the components of the device onto the mounting surface. The device may also include a separate signal indicia to indicate the operation of the device.

20 Claims, 5 Drawing Sheets

ILLUMINATED, PRESSURE-ACTUATED SWITCH

This is a continuation-in-part of U.S. patent application Ser. No. 07/491,542 filed on Mar. 12, 1990, now U.S. Pat. No. 5,118,910.

BACKGROUND OF THE INVENTION

The present invention is directed to an illuminated switching device and, more particularly, to an illuminated press-at-any-point pressure-actuated switching device.

Electrical switches for opening doors, sounding alarms, and for activating various other devices are well known in the art. In many applications, it is beneficial to provide a switch having an elongated or enlarged actuation surface, i.e., in contrast to a conventional button switch, which can be actuated by applying pressure over a relatively large area of the switch. Such press-at-any-point switches provide advantages in terms of convenience, safety, and flexibility in design.

For certain applications, it would be desirable to provide a press-at-any-point switch which is easy to detect and locate under adverse conditions such as during a smoky fire or in the dark. It would, therefore, be highly desirable to provide an illuminated press-at-any-point switching device. By providing illumination to a press-at-any-point switch, the safety and convenience in many applications may be greatly enhanced.

SUMMARY OF THE INVENTION

The present invention comprises an illuminated, press-at-any-point switching device which can be actuated by the application of or the removal of pressure at substantially any point along a surface provided along the switch. The press-at-any-point switching device includes a cover having at least one slot for holding the components of the device, an illuminating member positioned below the cover, and a switching assembly positioned below the illuminating member within the cover slot. The switching device preferably includes a mounting bracket to which the cover can be slidably mounted.

The cover preferably includes an upper slot and an assembly slot. The upper slot holds the illuminating member and the assembly slot is configured to hold the switching assembly and secure the cover to the mounting bracket. The upper slot and assembly slot maintain the illuminating member and switching assembly in continuous parallel relationship at a distance for actuation upon application of pressure to the surface.

The illuminating member provides a constant source of light to the switching device in both the activated and relaxed positions of the switch. Therefore, the switch may be easily located under adverse conditions such as darkness. The illuminating member is preferably a substantially planar body.

The switching assembly is a pressure-actuated switching arrangement. Generally, the switching assembly includes two electrically-conductive contacts separated in the relaxed condition to form an elongated actuation zone. When pressure is applied to the actuation zone, the contacts are moved into electrical communication.

The press-at-any point switching device may also include a signal indicia positioned above the illuminating member. The signal indicia may identify the operation of the switch, such as start.

The press-at-any point switching device, unlike conventional switches such as the button-type of switch, is actuated by the application of or the removal of pressure at substantially any point along the surface provided along the switch. The illuminating member adds the convenience and safety feature of illuminating the entire elongated actuation surface, thereby making the switch easy to locate under adverse conditions such as darkness or a smoky fire. The cover and bracket arrangement of the present invention provide a convenient method for assembling and maintaining proper positioning of the components of the illuminated, press-at-any point switching device as well as providing a convenient mounting device.

A preferred form of the illuminated, press-at-any point switching device, as well as other embodiments, objects, features, and advantages of this invention will be apparent from the following detailed description of illustrative embodiments, thereof, which is to be read in conjunction with the accompanying drawings.

Figure 5:
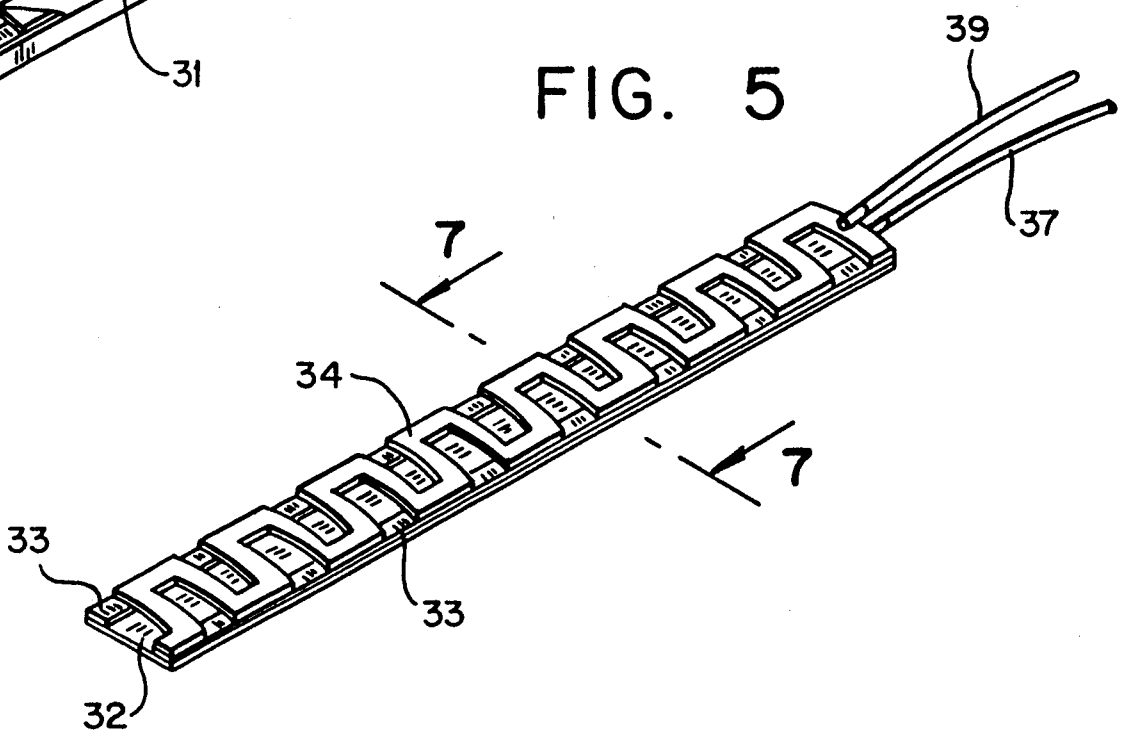
FIG. 5 is a perspective view of the electrically operative elements of the switch shown in FIG. 4.

FIGS. *7a* and *7b* are cross-sectional views taken along line 7—7 of FIG. 5.

Figure 8:
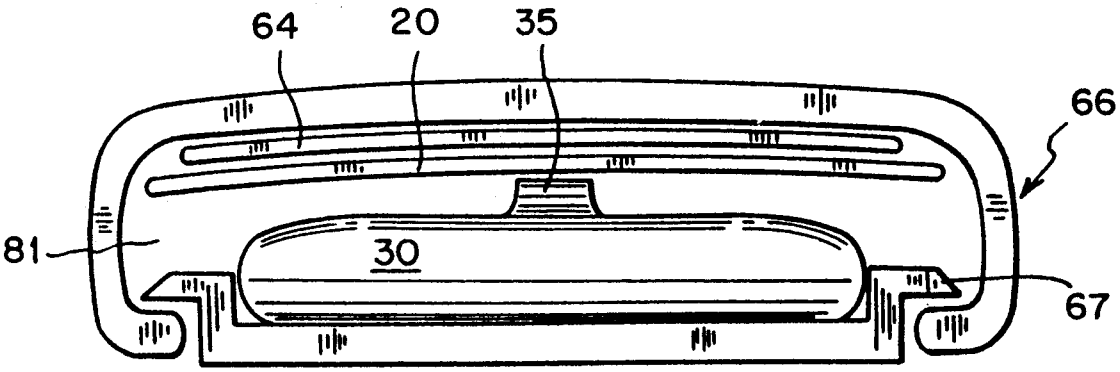

FIG. 8 is a cross-sectional view of an embodiment of the present invention having a cover with a single slot.

DETAILED DESCRIPTION OF THE PREFERRED EMBODIMENT

According to one preferred embodiment of the present invention illustrated in FIGS. 1-7, the illuminated, press-at-any-point switching device of the present invention includes a cover 66, a signal indicia 64 disposed under the cover, an illuminating member 20 disposed below the signal indicia 64 for providing a source of light, a pressure actuated switching assembly 30 which is provided with a protective sleeve 31 positioned below the illuminating member 20, and a bracket 60 which provides a mounting surface for the components listed above. In this embodiment, described in further detail below, each electrically operative element (illuminating member and switching assembly) may be protected by a moisture-proof barrier in order to provide added protection.

Figure 1:
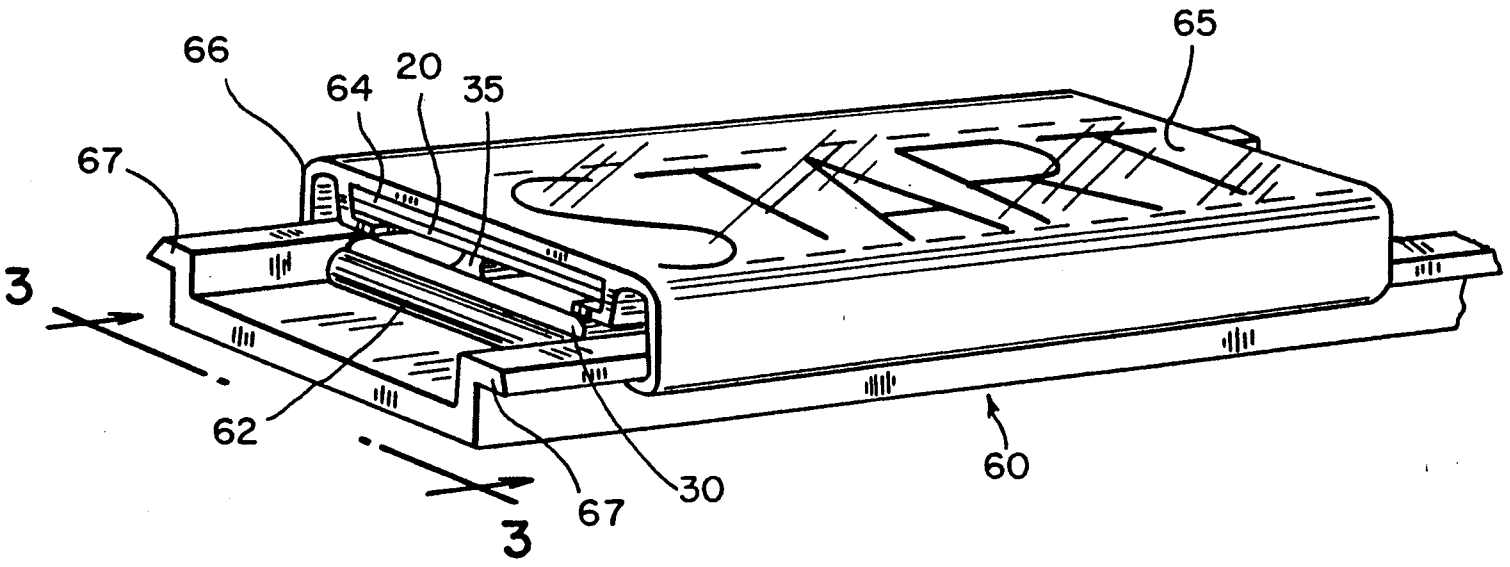
FIG. 1 is a top perspective view of one embodiment of the present invention.

With reference to FIG. 1, which illustrates one embodiment of an illuminated switching device of the present invention, the cover 66 may be made of either plastic or an impact resistant polycarbonate, such as Lexan®, a product of the General Electric Company. The material must be sufficiently flexible, however, to ensure that the surface layer 65 can be depressed under pressure which is exerted for operation of the switch during expected use. The material can be selected depending on the force required by the needs of the user.

The cover 66 can be made of translucent or opaque plastic with a word or symbol cut out on the top portion of the cover 66. The cut out area would allow illumination from below the cover 66 to be visible, thereby eliminating the need for separate signal indicia 64. The signal indicia 64 may be made from either plastic or metal and is substantially planar. The illuminating member 20 is positioned below the signal indicia 64 in order to provide a continuous source of illumination to the signal indicia 64 even when the switch is in the relaxed position. Therefore, the switch may be easily located under adverse conditions such as darkness.

The mounting bracket 60 includes a channel 68 flanked by outwardly extending flanges 67 which are continuous along both sides of the bracket 60. The flanges 67 provide structure for attaching the cover 66. The flanges need not be continuous, they can be intermittent to save material cost as long as there is sufficient attaching structure along the bracket 60.

Figure 2:
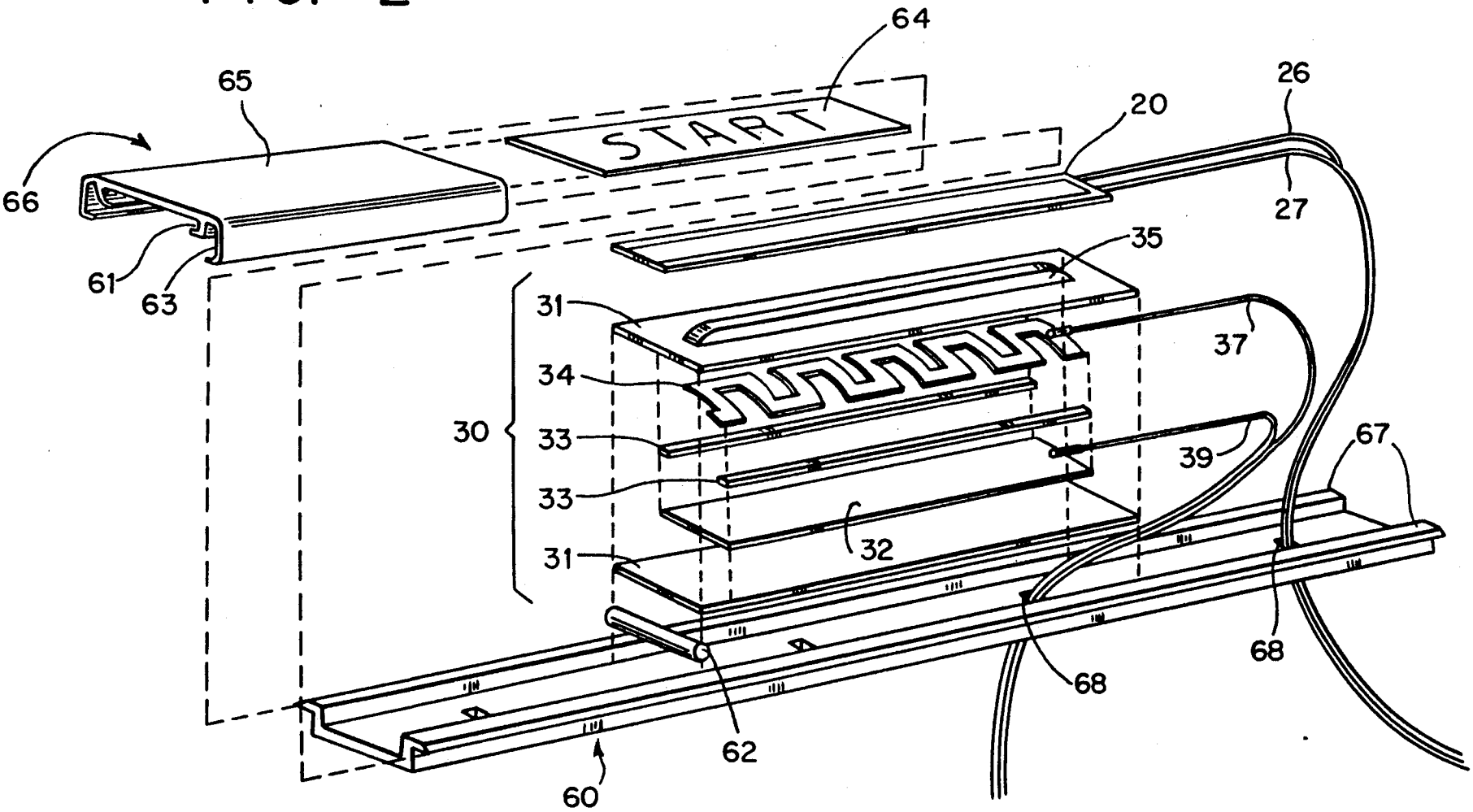
FIG. 2 is an exploded view of the embodiment of the present invention shown in FIG. 1.
Figure 3:
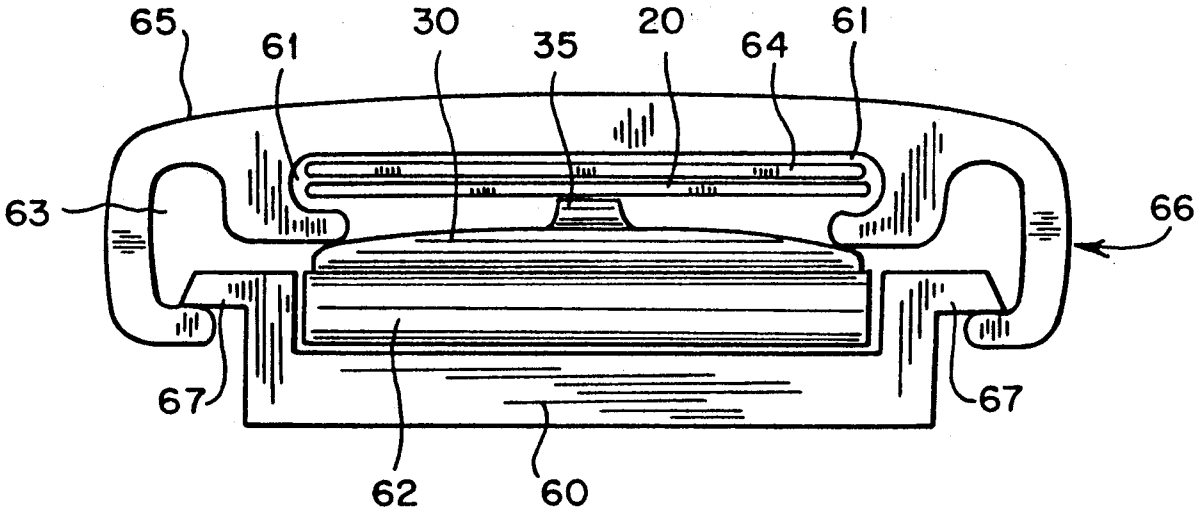
FIG. 3 is an end view of the embodiment of the present invention shown along lines 3—3 of FIG. 1.

In the illustrated preferred embodiment of the present invention shown in FIGS. 1-3, the translucent cover 66 contains an upper slot 61 and an assembly slot 63. The upper slot 61 is defined by an inside top surface of the cover and an L-shaped member extending down from the inside top of the cover. The upper slot 61 of the translucent cover 66 holds the signal indicia 64 and the illuminating member 20 adjacent to surface layer 65 in generally parallel relationship. The signal indicia 64 and illuminating member 20 are slidably positioned in the upper slot 61 and are held in position by the L-shaped members which define the upper slot 61.

The assembly slot 63 is configured to attach to the bracket 60 by sliding onto the outwardly extending flanges 67 of the bracket 60. The assembly slot 63 is dimensioned to secure switching assembly 30 between the bracket 60 and the illuminating member 20 so that a raised bead 35 is maintained in contact with, or within activation distance of, the illuminating member 20. It may be necessary to provide support(s) 62 in bracket 60 to secure the switching assembly in the operative position. The support 62 can be a cylindrical rubber retainer 62 transversely mounted on each side of the assembly within the channel formed in the bracket 60.

FIG. 2 is an exploded view of the embodiment of the present invention shown in FIG. 1. As shown in FIG. 2, the illuminating member 20 is preferably in the form of a luminescent lamp which receives power through electrical leads 26, 27. The illuminating member is preferably substantially planar in structure so that it can be positioned in the upper slot 61 of the translucent cover 66 to provide a constant source of illumination to the switching device. These planar lamps are commercially available in a number of sizes and shapes. As shown in FIG. 2, the bracket 60 has openings 68 on the bottom surface to accommodate electrical leads 37, 39 which can be attached to electrically-conductive members 32 and 34 of actuated switching assembly 30. An opening can also be provided for the electrical leads 26, 27 which are attached to the illuminating member 20. The bracket 60 also allows the pressure-actuated switching device to be mounted to a variety of surfaces.

Referring to FIG. 3, the switching assembly 30 of the preferred embodiment is located below the illuminating member 20 and above the bracket 60. The switching assembly 30 of the present invention can include a pressure-actuated switching arrangement. With reference to FIGS. 4-7, one preferred press-at-any-point switching assembly 30, which is durable while relatively inexpensive and easy to manufacture also includes a protective sleeve 31. The sleeve 31 is sealed at both ends to provide protection to the electrical elements of the switching assembly 30 from moisture and other deleterious environmental conditions.

Referring to FIGS. 4-7, the illustrated switching assembly 30 also has a lower electrically-conductive contact 32 and an upper electrically conductive contact 34 which are separated by electrical insulators 33. The electrically conductive contacts are connected to external sources of power and/or controls via wire leads 37,39, respectively. The insulators 33 are designed to maintain the electrically-conductive contacts 32,34 in spaced relation in the relaxed position thereby preventing electrical communication between the two contacts.

Figure 6:
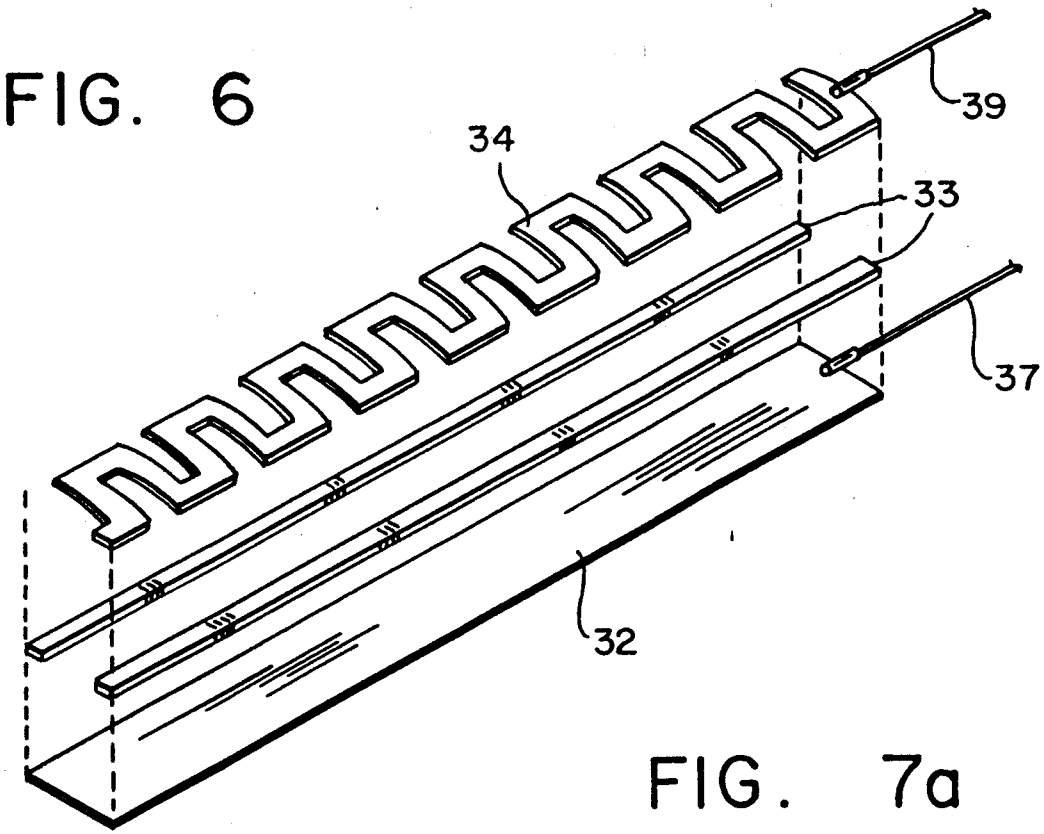
FIG. 6 is an exploded view of the electrically operative elements of the switch shown in FIG. 4.
Figure 7A:
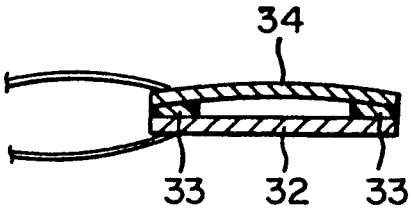
Figure 7B:
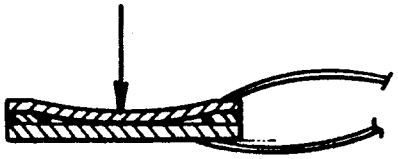

As shown more clearly in FIGS. 6 and 7*a*, insulators 33 are preferably disposed between the outer edges of contacts 32,34. In this fashion, when a force is applied to upper contact 34, the upper contact is moved toward lower contact 32 as shown in FIG. 7*b*, thereby establishing electrical communication between the contacts.

The electrically-conductive contacts may be formed of any suitable electrically-conductive material such as copper and may be formed in various configurations. It will be appreciated by those skilled in the art that the shape and dimensions of the electrical contacts may vary depending upon the particular application for which the switch is designed. For example, the deformation resistance of the upper electrical contact 34 may be decreased by removing selected portions thereof as shown in the illustrated embodiment. The insulators 33 may also be formed of conventional materials such as rubber, foam or plastics.

Figure 4:
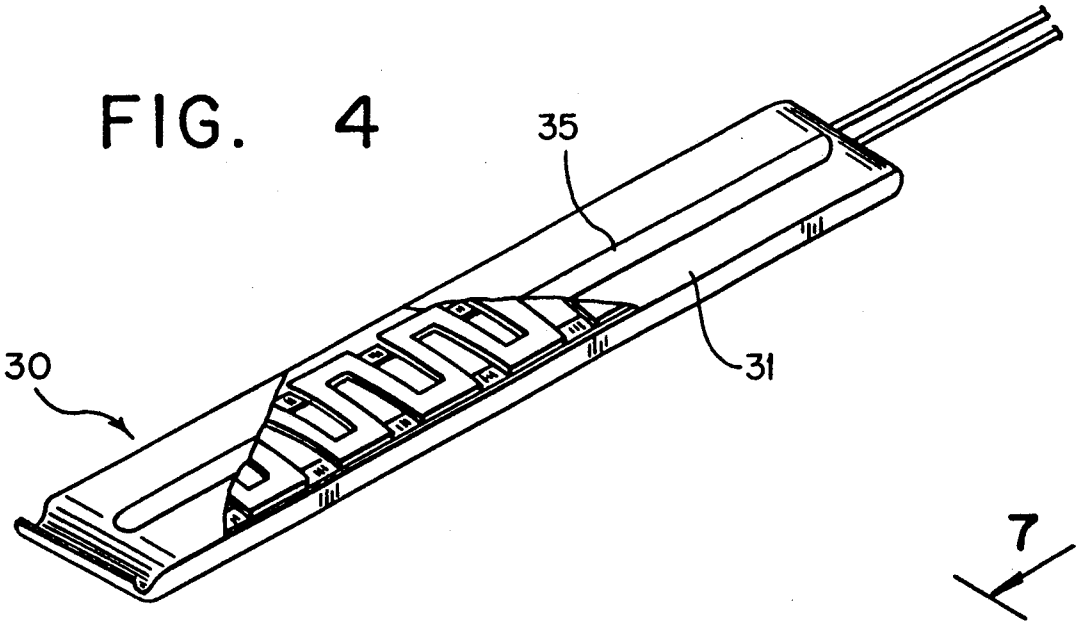
FIG. 4 is a perspective view with a section removed of a pressure actuated switch of one embodiment of the present invention.

With reference to FIGS. 2 and 4, the protective sleeve 31 may be formed of moisture proof materials such as polyvinylchloride. Other suitable materials include impact-resistant polycarbonates. Also, the protective sleeve 31 may advantageously be provided with a raised bead 35. It will be appreciated by those skilled in the art that the raised bead 35 helps to direct an applied pressure to the center portion of the contacts where the upper contact 34 has greatest resiliency. The cooperation of the bead 35 and relatively incompressible illuminating member 20 can effectively extend the actuation zone of this embodiment beyond the edges of the switching assembly 30. As used herein, the term "actuation zone" is meant to indicate the portion or portions of the switching device at which the application of pressure will result in electrical communication between the contacts.

Another embodiment of the present invention may include a plurality of switching devices positioned adjacent to each other under separate covers, each with its own specific purpose. For example, one switch may be used to start an operation while an adjacent switch may be used to stop the same operation.

In still another embodiment of the present invention illustrated in FIG. 8, the cover 66 is preferably formed with a single slot 81. The slot 81 is configured to securely hold the signal indicia 64, the illuminating member 20, and the pressure-actuated switching assembly 30 onto the bracket 60. As described in the previous embodiment of the present invention, the slot 81 is configured to attach to the bracket 60 by sliding onto the outwardly extending flanges 67 of the bracket 60. The pressure-actuated switching assembly 30 may be enclosed in a protective sleeve 31 and include a raised bead 35 as previously described.

Alternatively, a moisture-proof outer envelope (not shown) may be used to enclose the electrically operative elements (the illuminating member 20 and the pressure actuated switching assembly 30). The outer envelope may be opaque and provided with a translucent window or may be formed entirely of a translucent material to allow the illuminating member 20 to provide a constant source of illumination to the signal indicia 64.

Thus, while there have been described what are presently believed to be the preferred embodiments of the present invention, those skilled in the art will understand that other and further embodiments can be made without departing from the spirit of the invention, and it is intended to include such embodiments which fall within the true scope of the invention as pointed out in the following claims.

What is claimed is:

1. An illuminated, press-at-any point switching device comprising:

a switching assembly having a first, electrically-conductive contact and a second electrically-conductive contact, said first contact movably positioned relative to said second contact and forming an elongated actuation zone wherein pressure applied to said actuation zone causes said contacts to move into electrical communication;

means for illuminating which illuminates in the presence of electrical current applied thereto, having a continuous planar body disposed along said switching assembly and positioned substantially parallel thereto whereby said illuminating means is a constant source of illumination for said device; and means assembling said switching assembly and said illuminating means in continuous parallel relationship at a distance such that pressure applied along a portion of said assembling means brings said contacts of said switching assembly into electrical communication, said assembling means having a continuous elongated body with at least one slot defined by an inside top surface of the assembly means and a pair of L-shaped members extending down from each edge of the inside top surface of the assembly means which holds said illuminating means and said switching assembly in said parallel relationship.

2. An illuminated press-at-any point switching device, according to claim 1, wherein the assembling means comprises an upper slot which holds said illuminating means and an assembly slot defined by a pair of L-shaped members positioned below the upper slot which secures said switching assembly in said parallel relationship with said illuminating means.

3. An illuminated press-at-any point switching device according to claim 2, further comprising a signal indicia positioned between the inside top surface of the assembly means and a top surface of the illuminating means in the upper slot of the assembling means.

4. A switching device according to claim 1 wherein said assembling means is substantially translucent.

5. A switching device according to claim 1 wherein said assembling means comprises plastic.

6. A switching device according to claim 1 wherein said assembling means comprises an impact-resistant polycarbonate.

7. A switching device according to claim 1 further comprising a protective sleeve which substantially encloses said switching assembly.

8. A switching assembly according to claim 7 wherein said protective sleeve comprises plastic.

9. A switching assembly according to claim 7 wherein said protective sleeve comprises an impact-resistant polycarbonate.

10. A switching device according to claim 7 wherein said protective sleeve further comprises a raised bead to facilitate the switching assembly contacts to come into electrical communication when pressure is applied to said assembling means.

11. A switching device according to claim 1 wherein said contacts are disposed in close proximity and are normally separated by at least one insulating member.

12. A switching device according to claim 1 further comprising a protective sleeve which substantially encloses said switching assembly and said illuminating means.

13. A switching device according to claim 12 wherein the protective sleeve comprises a translucent material.

14. A switching device according to claim 1, further comprising means mounting the switching device, said mounting means providing a mounting surface disposed below the switching assembly and positioned within the slot of the assembling means.

15. A switching device according to claim 14 wherein said mounting means comprises plastic.

16. A switching device according to claim 14 wherein said mounting means comprises metal.

17. A switching device according to claim 14 further comprising a signal indicia disposed under said assembling means and above said illuminating means.

18. A switching device according to claim 17 wherein said signal indicia comprises plastic.

19. A switching device according to claim 14 further comprising means for securing said assembling means on said mounting means.

20. A switching device according to claim 14, wherein said mounting means includes a bottom surface having openings to accommodate electrical leads from the illuminating means and switching assembly.

* * * * *